United States Patent [19]

Monich

[11] 4,395,948

[45] Aug. 2, 1983

[54] STRUCTURED MOUNTING FOR A HAND STAMP

[76] Inventor: Michael T. Monich, 810 Mohawk Dr., Huron, Ohio 44839

[21] Appl. No.: 397,846

[22] Filed: Jul. 13, 1982

[51] Int. Cl.[3] ..... B41K 1/56

[52] U.S. Cl. ..... 101/405; 40/328; 33/184.6

[58] Field of Search ..... 101/327, 368, 405, 406; 40/328; 33/184.6

[56] References Cited

U.S. PATENT DOCUMENTS

| | | | |
|---|---|---|---|
| 894,013 | 7/1908 | Kiam | 101/405 |
| 1,122,903 | 12/1914 | Gebhardt | 101/368 X |
| 1,263,094 | 4/1918 | Millea | 101/405 X |
| 1,420,376 | 6/1922 | Hellesoe | 101/405 |
| 1,972,953 | 9/1934 | Reynolds | 101/405 |
| 3,023,701 | 3/1962 | Anderson | 101/405 |
| 3,142,082 | 7/1964 | Harwood | 101/368 X |

*Primary Examiner*—Edgar S. Burr
*Assistant Examiner*—John A. Weresh

[57] ABSTRACT

A hand-held mounting for a rubber stamp structured from a series of hingably connected flat sheet panels. One set of panels are arranged into a wedge-shaped outer body and gripping handle. Other panels are held captively within the outer body configuration and arranged to serve as structural load-supporting elements. A separate shim is used to preload and stiffen the combination of inner and outer structures after being securely stapled together. Alternatively, readily removable securement devices are used to permit the knockdownability of the structure into a flat form when so desired.

11 Claims, 12 Drawing Figures

STRUCTURED MOUNTING FOR A HAND STAMP

FIELD OF THE INVENTION

This invention relates to hand-held mountings for rubber stamp dies and, more particularly, to mountings made of sheet paperboard which when cut, scored and bent, are adapted for structuring into such stamp mountings.

DESCRIPTION OF PRIOR ART

The wooden block to which a bulb-shaped wooden handle is centrally attached by tenon is a well recognized hand-held mounting for a rubber stamp. Another popular type mounting is the wooden strip moulding which provides both block and continuous handle of the same length. Various plastic constructions and self-inking designs are also available.

While the old standard and newer types have been generally satisfactory from a functional standpoint, their economic-related drawbacks have become increasingly apparent.

For example, a depressed furniture market creates a shortage of cherry and walnut wood remnants—long an important low-cost source of these low-warpage woods for rubber stamp mountings. Likewise, high oil prices affect the cost of the aforementioned plastic constructions. Further, drastic postal increases have made product and packaging weight of crucial concern to the rubber stamp mailorder business.

SUMMARY OF THE INVENTION

Accordingly, a general object of this invention is to provide a hand-held mounting for rubber stamps which overcomes many of the drawbacks cited in the Description of Prior Art, yet retain desirable essentials, and also introduces several new attractive attributes to this field of art.

A specific object of this invention is to provide a flat sheet blank adapted to structure into a hand-held mounting for rubber stamps using abundant and economical material such as paperboard, or the like.

Another object of this invention is to provide a rubber stamp mounting which has a light weight—and especially a low packaged mailing weight.

Still another object of this invention is to provide a stamp mounting which is readily knockdownable and collapsed into a flat form thereby enhancing its facility for mailing, or storage after use.

Yet another object of this invention is to incorporate tensile and compressive preloading in the structural members of the mounting thereby giving the mounting considerably more rigidity than it would have without preloading.

Further, another object of this invention is to provide a stamp mounting having a convenient hand gripping area and a center gripping locator to assure that the hand stamp is gripped centrally for optimum performance.

Yet a further object of this invention is to provide a mounting with readily interchangeable dual stamp capacity.

Other objects, features and advantages of the invention will become more apparent when reference is made to the detailed descriptions relating to the accompanying drawings.

DESCRIPTION OF TWO PREFERRED EMBODIMENTS THE PRELOADED DESIGN EMBODIMENT

Figure 1:
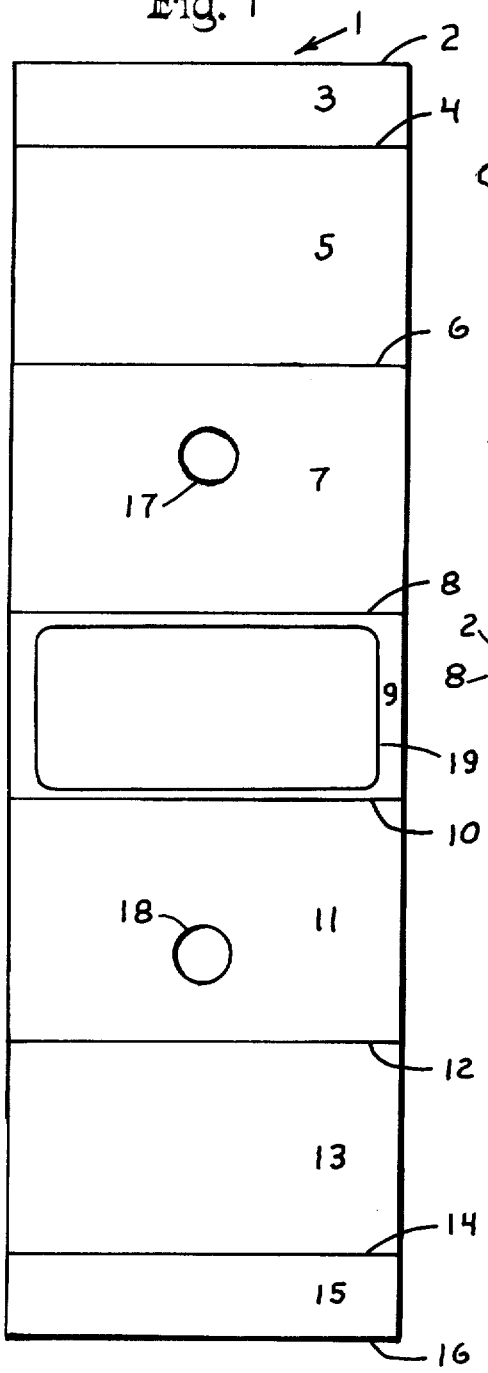
FIG. 1 is a layout view of a rectangular flat blank having six parallel scored lines and two punched holes from which a structured mounting for a rubber stamp is made in accordance with the present invention.

Referring now to details of the drawings, FIG. 1 is a layout view of a flat blank 1 for a stamp mounting constructed in accordance with the principles of the present invention. The single rectangular blank 1 is divided symetrically into seven rectangular shaped panels hingeably connected by transverse parallel scored lines extending across the full width of blank 1 and parallel with its short side edges, 2 and 16.

Reading the FIG. 1 drawing from top to bottom, the sequence of adjacent edges, panels, and scored lines are arranged in tandom as follows: Left foot panel side edge 2 is adjacent to left foot panel 3 which is adjacent to scored line 4 which is adjacent to left leg panel 5 which is adjacent to scored line 6 which is adjacent to left skirt panel 7 which is adjacent to scored line 8 which is adjacent to base panel 9 which is adjacent to scored line 10 which is adjacent to right skirt panel 11 which is adjacent to scored line 12 which is adjacent to right leg panel 13 which is adjacent to score line 14 which is adjacent to right foot panel 15 which as an adjacent right foot panel side edge 16. It will be noted that said left and right skirt panels 7 and 11 incorporate transversly centralized gripping holes 17 and 18 respectively. Further, said base panel 9 indicates the layout position of an affixed rubber stamp die 19. It will also be noted that blank 1 is symetrical about both its central horizontal as well as its central vertical axes.

Figure 2:
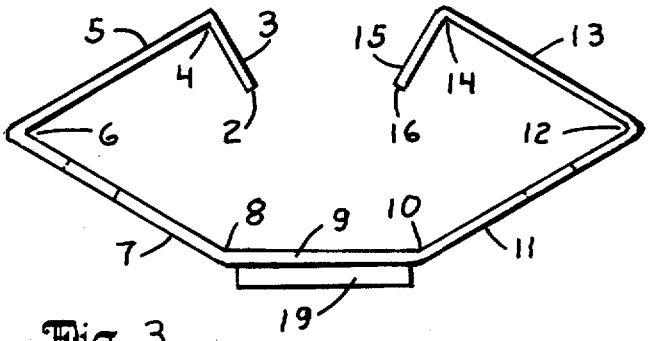
FIG. 2 shows an end view of the FIG. 1 blank partially bent along its scored crease lines.

FIG. 2 is an end view of blank 1 in an uncompleted bending stage showing the clockwise directional bending taken by sides of the left group of panels 3,5,7 and the counterclockwise directional bending taken by sides of the like right group of panels 11, 13, 15 along their applicable mutually adjacent scored lines 4,6,8,10,12,14 in relation to the horizontally positioned base panel 9. Shown forming at scored lines 8 and 10 are what will become the inside vertices between the top surface of base panel 9 and the sloping inside surfaces of said left and right skirt panels 7 and 11 respectively. The end view position taken by a functional rubber stamp die 19 is shown when affixed to the horizontal bottom surface of base panel 9.

Figure 3:
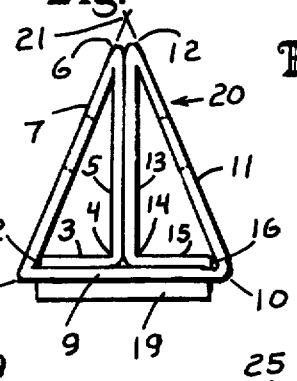
FIG. 3 shows an end view of the fully bent FIG. 1 blank forming a wedge-shaped, structured configuration of panels.

FIG. 3 is an end view of the complete wedge-shaped structured configuration 20 formed from blank 1 with all panels in position but not secured. The left skirt panel 7, hingeably connected to a common side with base panel 9 at score line 8, is directed upwardly and inwardly toward a common virtual first apexial line 21 also shared by right skirt panel 11 which is similarly directed upwardly and inwardly, being also hingeably connected to a common opposite side of base panel 9 at scored line 10. The left leg panel 5, hingeably connected to the left skirt panel 7 at scored line 6, is directed vertically downwards until its lower boundary at scored line 4 bottoms on base panel 9. The right leg panel 13, hingeably connected to the right skirt panel 11 at scored line 12, is similarly directed vertically downward until its lower boundary at scored line 14 bottoms on base panel 9. The inward facing surfaces of leg panels 5 and 13 are now in juxtaposition contact. The left foot panel 3, hingeably connected to the left leg panel 5 at scored line 4, is directed horizontally outward to the left until its left foot side edge 2 wedgingly contacts the sloping inner surface of the left skirt panel 7. The right foot panel 15, hingeably connected to the right panel 13 at scored line 14, is similarly directed horizontally outward but to the right until its right foot edge 16 wedgingly contacts the sloping inner surface of the right skirt panel 11. The bottom surfaces of the horizontal foot panels 3 and 15 are now in light contact with the top surface of the horizontally positioned base panel 9. The adjacent scored lines 6 and 12 now become twin apexial lines at the top of the unsecured wedge-shaped structured configuration 20.

Figure 4:
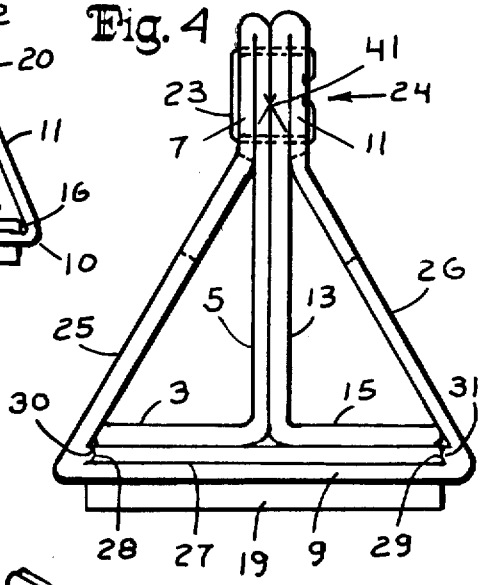
FIG. 4 shows an enlarged end view of the stamp mounting in a unitized structured form with panels securely stapled together to form a handle for the stamp mounting and with the preloading spacer in position.
Figure 5:
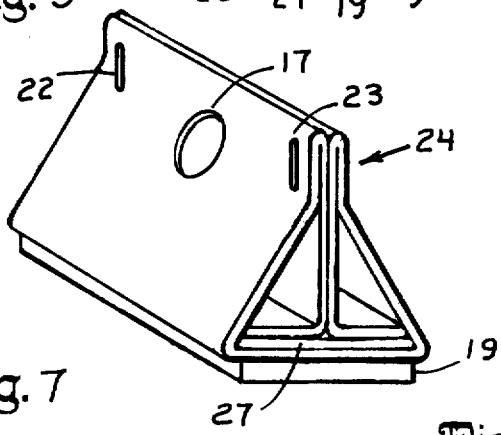
FIG. 5 shows a perspective view of the completed and preloaded structured mounting for a hand-held rubber stamp, and the general relative locations of the staples, handle, and gripping hole(s).

FIG. 4 and FIG. 5 show, respectively, an enlarged end view and a corresponding nonenlarged perspective view of a completed structured mounting in a preloaded embodiment ready for use. Clinching staples 22 and 23 are driven, respectively, into and near each top corner of the structured mounting below the now said twin apexial score lines 6 and 12, thereby causing the stapled upper portions of the left skirt panel 7 and right skirt panel 11 to assume a vertical position and clinchingly sandwich the adjacent top portions of the vertical left leg panel 5 and right leg panel 13 to form a rigid and smooth four-ply vertical handle 24 for the stamp mounting, while also serving to decrease the slope of the unstapled portion of the now shortened skirt panels 25 and 26 and lowering their common virtual second apexial line 41. It may be noted that the combined length of the remaining sloping skirts 25 and 26 plus their now stapled vertical portion in the handle 24, geometrically appear greater than their former unstapled skirt lengths, a condition made possible by taking up the slack which inherently exists in a newly folded paperboard structure. The structured mounting of FIG. 4 is now ready to be preloaded to make it more rigid. This is accomplished by employing an adequately proportioned shim 27 shown in FIG. 6. Shim 27 has a thickness great enough to create a vertical interference fit when it is inserted between the bottom surfaces of the foot panels 3 and 15, and the top surface of base panel 9. Additionally, the shim 27 lateral width is such that a horizontal interference fit results when shim side edges 28 and 29 are inserted between the narrower inside straddle of vertices formed by the sloping skirt panels 25 and 26 at a point where yielding delamination ridges 30 and 31, which characteristically occur in the scored lines of pasteboard when creased, are located to assure a firm locking seat for the shim side edges 28 and 29 in spite of expected tolerance variations in the manufacture, materials, and assembly of the separate components of the preloaded mounting.

It will be noted that, when preloaded, the left and right leg panels 13 and 5, are in a vertical "tent pole" compression mode while the left and right foot panels 3 and 15 are in laterial horizontal compression. The shim panel 27 is in compression in a horizontal as well as vertical direction. These compressive forces serve to place the base panel 9 in a lateral tensile stretch mode providing a desirable horizontal flattening and straightening effect. A lateral tensile force also results in the remaining inclined portions of the skirt panels 25 and 26 providing a "guy wire" type stability to the mounting handle 24 and to the entire preloaded structured mounting itself.

Figure 6:
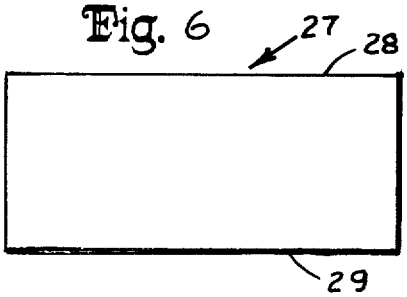
FIG. 6 shows a layout view of the preloading shim shown in FIG. 4 and 5.

FIG. 6 shows a layout view of the aforementioned and described shim 27 with side edges 28 and 29 corresponding in length to the transverse lines scored on opposing boundry sides of base panel 9.

Figure 7:
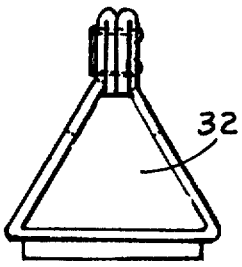
FIG. 7 shows an end view of the preloaded structured mounting with ends covered.

FIG. 7 shows an end view of the preloaded structured mounting including the face surface of one end closure 32 intended primarily for cosmetic purposes. Although the end closure as shown is bent from an extended preloading shim, it could emanate from the base panel, or other panel and incorporate retension flaps by methods well known in box design technology.

Figure 8:
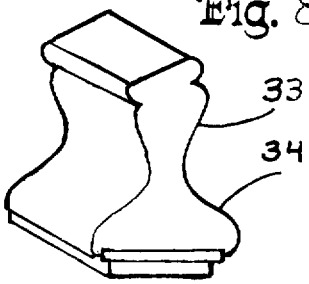
FIG. 8 shows a perspective view of a prior art hand-held rubber stamp mounting of the moulded wooden strip type.

FIG. 8 shows a perspective view of a prior art handheld rubber stamp mounting of the molded wooden strip type with handle 33 length equal to the length of body 34 of the mounting. The relative massiveness of even this narrow prior art mounting can be readily appreciated.

THE KNOCKDOWNABLE DESIGN EMBODIMENT

Figure 9:
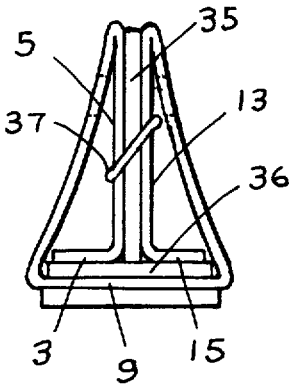
FIG. 9 shows an end view of a knockdownable structured mounting for a hand-held rubber stamp made from a FIG. 1 - Type blank.

FIG. 9 shows an end view of one design embodiment for a knockdownable structured mounting for a handheld rubber stamp. The similarity of this design to the rigid preloaded design described in FIG. 4 and 5 is evident from the fact that the previously given description relating to FIGS. 1, 2, and 3 also apply as an introduction to the knockdownable design of FIG. 9, which additionally provides other important attributes. For example, FIG. 9 employs the FIG. 3 structured configuration, and additionally, a relatively stiff separate vertical reinforcement panel 35, a separate horizontal reinforcement panel 36, and a readily attachable and detachable free-floating securement device 37.

The vertical reinforcement panel 35 has length and width dimensions substantially equal to those of the previously described left and right leg panels 5 and 13 and is loosely positioned in alignment and between these leg panels. Likewise, the horizontal reinforcement panel 36 has length and width dimensions substantially equal to the previously described base panel 9 and is loosely positioned in alignment and between the base panel 9 and previously described left and right foot panels 3 and 15. The stiffness of the vertical and horizontal reinforcement panels 35 and 36 is somewhat greater than the inner and outer panels which make up the structured configuration of panels of FIG. 3 due in part to their somewhat greater thickness and in part to the use of more dense paperboard or other materials.

A preload does not occur in the inner and outer panels of the structured configuration of panels in the knockdownable design from the loose placement of the vertical and horizontal reinforcement panels 35 and 36, because with no fixed securement means present, the six scored lines 4, 6, 8, 10, 12, 14 of blank 1 shift their normal crease position sufficiently to accomodate the addition of the vertical and horizontal reinforcement panels 35 and 36. Unitizing the structured configuration by a free-floating securement clip 37 after the reinforcement panels are in place, does not alter this nonpreloaded state. The drape of the skirt panels also provide lateral slack.

The securement clip 37 shown in FIG. 9 is a standard double wire loop office paper clip which when inserted into the open end of the mounting, free-floatingly grips the leg panels 5 and 13 and the vertical reinforcement panel 35 therebetween. For the larger mountings, multiple clips are employed. In this mode, the arranged configuration shown in FIG. 9 becomes unitized for practical use as a structured mounting for a hand-held rubber stamp. The structured mounting of FIG. 9 is knockdownable since the easily removed clips permit the structured mounting to collapse into a convenient flat form for filing in a standard envelope imprinted with the legend of the stamp so filed. This feature is especially attractive for infrequently used or large handstamps. For the mail-order manufacturer of such stamps, the mailing advantages are obvious.

Figure 10:
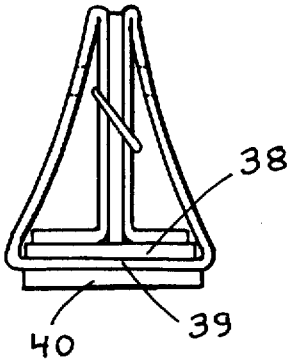
FIG. 10 shows an end view of a knockdownable structured mounting with provisions for dual rubber stamp capability.

FIG. 10 shows an end view of a knockdownable structured mounting made from a blank concept similar to that shown in FIG. 1, except appropriately proportioned to accomodate a second rubber stamp die 38 affixed to the upper surface of base panel 39. The first rubber stamp die 40 is affixed to the bottom side of base panel 39, the functional position. However, since the FIG. 1 type blank is symetrical about both its horizontal and vertical centroidal axes and the structured mounting is knockdownable with multi-directional bendable score lines, turning the structured mounting shown in FIG. 10 completely "inside out" will exchange the spatial positions of the first rubber stamp die 40 with the second rubber stamp die 39, and place the latter into functional position at the bottom of the reversed structured mounting. Such dual stamp capability in one mounting has obvious space-saving and handling appeal. The use of heavier moisture-resistant treated pasteboard is needed for this application, and this generally precludes the need for using horizontal or vertical reinforcement panels except in large stamp sizes.

Figure 11:
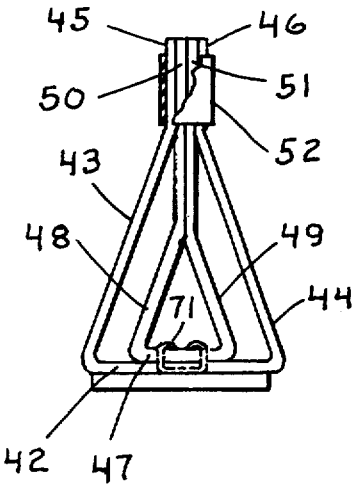
FIG. 11 shows an end view of a flat knockdownable structured mounting made from two separate blanks.

FIG. 11 shows an end view of a knockdownable structured mounting for handheld rubber stamps wherein a first blank is used to construct an outer panel configuration comprising the outer lower base panel 42, left and right outer skirt panels 43 and 44, and left and right outer handle panels 45 and 46, respectively, and a second blank is used to construct an inner panel configuration comprising the inner and upper base panel 47, the left and right inner skirt panels 48 and 49, and the left and right inner handle panels 50 and 51, are respectively. It will be noted that the upper and lower base panels 47 and 42 are joined together with staple 71 for rigidity. In addition, the aforementioned four handle panels 45, 46, 50, 51 are circumvented by a stour office rubber band, shown in partial section, which serves as a gripping surface for the structured mounting and also as a readily applied and removed securement device 52 that holds the aforementioned panels in a unitized configuration ready for use as a structured mounting for hand-held rubber stamps. Removal of the securement device 52 permits the structure to be collapsed into a convenient flat form.

Figure 12:
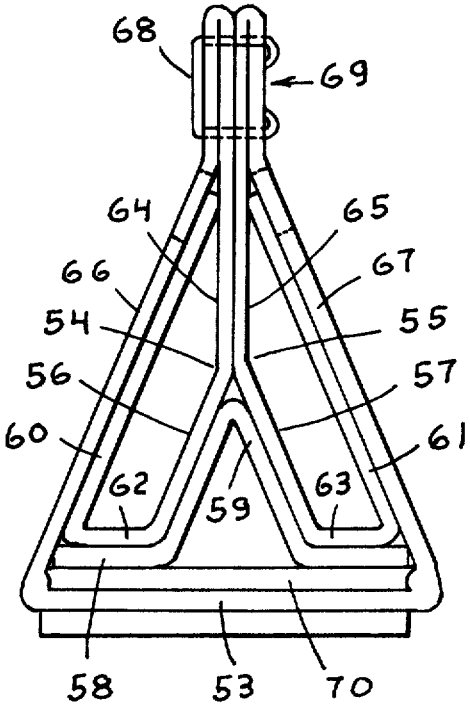
FIG. 12 shows an alternate knockdownable structured mounting suitable for extra large hand-held rubber stamps.

FIG. 12 shows an end view of a preloaded structured mounting employing several alternate features over those shown in FIG. 4 especially adapted for the larger size rubber stamp dies. FIG. 12 illustrates a means to distribute the base panel 53 loads more uniformly by use of knees 54 and 55 which diverge the lower leg panels 56 and 57 into a straddling position, a separate horizontal reinforcement and preloading panel 58 incorporating a center ridge 59 for added straddle support and left and right toe panel 60 and 61, which hingably extend from left and right foot panels 62 and 63, then are directed upwardly and inwardly to wedge between upper leg panels 64 and 65 and corresponding adjacent skirt panels 66 and 67 to act as skirt reinforcement panels. The entire structure is secured by staple 68 in the handle assembly 69. Additional preload in the structure is obtained by a separate flat preloading shim 70 inserted between the base panel 53 and the rigid preloading and horizontal reinforcement panel 58.

I claim:

1. A preloaded structured mounting for a hand-held rubber stamp made from a single rectangular blank of paperboard, cut, scored and bent, along predetermined transverse parallel lines which define side boundaries between a multiplicity of hingably connected rectangular panels arranged in tandom comprising:

(a) three symetrically arranged outer panels, including a horizontally positioned base panel hingably connected on opposing transverse sides to a set of two like mirror-imaged left and right skirt panels sloping upwardly and inwardly toward each other and toward a common top apexial line, (b) a multiplicity of left and right sets of symetrically arranged inner panels forming sides for a multiplicity of intimately confined load-supporting polygons located within the inside boundries of said arranged outer panels, (c) a substantially fixed securement means for holding said arranged outer and inner panels in a unitized structured form, (d) a gripping means located near said top apexial line for handling said structured mounting thereat, (e) a means to stiffen said unitized structured form whereby a lateral tensile preload is created in said arranged outer panels, and simultaneously, a lateral compressive preload is created in said arranged inner panels, said means to stiffen said unitized structured form being accomplished by a separate flat shim having thickness dimensions sufficiently large to create, upon insertion, thereat, a vertical interference fit between the top surface of said horizontally positioned base panel and the bottom surfaces of adjacent elements of said arranged inner panels, and simultaneously having laterial dimensions sufficiently large to create, upon insertion thereat as described, a horizontal interference fit between the side edges of said separate flat shim and the base vertex lines of said left and right skirt panels sloping upwardly and inwardly from said horizontally positioned base panel.

2. The preloaded structured mounting described in claim 1, wherein said outer panels are formed from a first blank and the said inner panels are formed from a separate second blank.

3. The preloaded structured mounting described in claim 1, wherein said substantially fixed securement means is provided by staples clenchingly joining a sufficiently sized upper portion of said left and right skirt panels together with adjacently connected and sandwiched portions of said inner panels thereat, stapled said upper portions of sloping said left and right skirt panels and effected said sandwiched portions of said inner panels are thereby redirected vertically and upwardly thereat, and form a rigid vertical strip for said gripping means thereby, the remaining lower portions of said left and right skirt panels thereafter assume like slopes with a lower positioned but increased apexial angle while in a said unitized structured form.

4. The preloaded structured mounting described in claim 3, wherein said rigid vertical strip forms said gripping means including an opposing set of transversly centralized gripping holes located in the top half of said left and right skirt panels substantially adjacent to said rigid vertical strip.

5. The preloaded structured mounting described in claim 1 wherein said left and right sets of symetrically arranged inner panels includes additionally:

(a) a set of like juxapositioned vertical upper leg panels extending from substantially the upper part of said mounting to a midheight thereof, (b) a set of like diverging lower leg panels hingably connected to said upper leg panels by score lines and extending downwardly and outwardly to a set of like horizontally directed foot panels directed parallel to said base panel thereat, and outwardly directed into contact with the inner surface of set of sloping said left and right skirt panels, (c) a set of like toe panels hingably connected to said foot panels by score lines and extending upwardly and inwardly into a wedging relationship between said set of vertical leg panels and said set of outer left and right skirt panels, (d) an additional means to stiffen said unitized structured form whereby a separate second shim of appropriate thickness is positioned between the top surface of said flat shim and the bottom surfaces of said diverging lower leg panels, said second shim incorporating anapexial ridge of dimensions sufficient to intimately contact inside surfaces of said diverging lower leg panels.

6. A knockdownable structured mounting for a handheld rubber stamp made from a single rectangular blank of paperboard cut, scored and bent, along predetermined transverse parallel lines which define side boundaries between a multiplicity of hingably connected rectangular panels arranged in tandom comprising:

(a) three symetrically arranged outer panels, including a horizontally positioned base panel hingably connected on opposing transverse sides to a set of two like mirror-imaged left and right skirt panels sloping upwardly and inwardly toward each other, and toward a common top apexial line, (b) a multiplicity of left and right sets of symetrically arranged inner panels forming sides for a multiplicity of intimately confined load-supporting polygons located within the inside boundries of said arranged outer panels, and including left and right juxapositioned leg panels hingably connected, respectively, to the top of said left and right skirt panels and directed vertically downward, forming twin apexes, thereby, to the plane of said horizontally positioned base panel and there hingably connected, respectively, to like left and right foot panels horizontally directed parallel to said base panel thereat, and outwardly directed into contact, respectively, with the lower sloping inner surface of said left and right skirt panels, (c) a readily attachable and detachable securement means for temporarily holding said arranged outer panels and said arranged inner panels in a substantially unitized structured configuration, yet adapted to flat knockdown, (d) an integrated gripping means including an opposing set of transversly centralized gripping holes located in the top half of said left and right skirt panels sloping toward their common top apexial line.

7. The knockdownable structured mounting described in claim 6, wherein the said outer panels are formed from a first blank and the said inner panels are formed from a separate second blank.

8. The knockdownable structured mounting described in claim 6, and including a separate vertical reinforcement panel made of relatively stiff material, said separate vertical reinforcement panel having a length substantially equal to the length of said transverse parallel lines which define side boundries of said inner and outer panels, and having a height substantially equal to the height of said left and right juxapositioned leg panels, and being positioned therebetween said left and right leg panels.

9. The knockdownable structured mounting described in claim 6, and including a separate horizontal reinforcement panel made of relatively stiff material, said separate horizontal reinforcement panel having length and width dimensions substantially equal to that of said horizontally positioned base panel, and being positioned thereat on top surface of said base panel.

10. The knockdownable structured mounting described in claim 6, wherein said readily attachable and detachable securement means is a common office paper clip free-floatingly positioned substantially parallel to said horizontal base panel and gripping the vertically positioned said left and right juxapositioned leg panels and thereby firming an erected said unitized configuration of said structured mounting, removal of said detachable securement means providing the ability thereby, for elements of said knockdownable structured mounting to be collapsed into a convenient flat form.

11. The knockdownable structured mounting described in claim 6, including a provision for dual stamp capability wherein a second rubber stamp die is affixed to the base panel top surface simultaneously with a functionally positioned first rubber stamp die affixed to the base panel bottom side of same said base panel, said provision being a compensating size reduction of said inner panels, and the symetrical arrangement of said inner and outer panels permitting a functional inside-out reversibility of the said unitized configuration thereby.

* * * * *